US009597572B1

(12) United States Patent
Copenhaver

(10) Patent No.: US 9,597,572 B1
(45) Date of Patent: Mar. 21, 2017

(54) MINIATURIZED STEER ROPING PRACTICE APPARATUS

(71) Applicant: Alan R. Copenhaver, Hinton, IA (US)

(72) Inventor: Alan R. Copenhaver, Hinton, IA (US)

(73) Assignee: Hot Heels, Inc., Hinton, IA (US)

( * ) Notice: Subject to any disclaimer, the term of this patent is extended or adjusted under 35 U.S.C. 154(b) by 0 days.

(21) Appl. No.: 15/042,195

(22) Filed: Feb. 12, 2016

(51) Int. Cl.
*A63B 69/00* (2006.01)
*G09B 19/00* (2006.01)
*A63H 29/04* (2006.01)

(52) U.S. Cl.
CPC ..... *A63B 69/0068* (2013.01); *G09B 19/0038* (2013.01); *A63H 29/04* (2013.01)

(58) Field of Classification Search
CPC .... A63B 69/0068; A63H 29/00; A63H 29/18; A63H 29/20; A63H 29/24; A63H 29/04; A63H 29/06
USPC ..... 273/359, 366–370; 446/457, 459, 461, 446/462, 464
See application file for complete search history.

(56) References Cited

U.S. PATENT DOCUMENTS 108,224 A * 10/1870 Wickham ..... A63H 29/18 446/459
1,203,438 A * 10/1916 Webster ..... A63H 29/18 446/459
1,599,101 A * 9/1926 Savage ..... A63H 29/06 188/184
2,741,873 A * 4/1956 Erickson ..... A63H 29/06 446/457
2,881,864 A * 4/1959 Rubenstein ..... A63H 29/06 185/37
3,066,939 A 12/1962 Sprout
3,303,821 A * 2/1967 Harris ..... A01K 15/027 119/839
3,601,924 A * 8/1971 Lechner ..... A63H 29/18 446/459

(Continued)

FOREIGN PATENT DOCUMENTS

CA 2187825 4/1998

OTHER PUBLICATIONS

GP Manufacturing, LLC, "Speed Roper & Speed Header" website, product information, Jan. 8, 2007, 10 pages, www.teamroper.com/speed.

*Primary Examiner* — Mark Graham
(74) *Attorney, Agent, or Firm* — Jeffrey A. Proehl; Woods, Fuller, Shultz & Smith, P.C

(57) ABSTRACT

A miniaturized steer roping practice apparatus may comprise a mobile base comprising a frame, an axle rotatably mounted on the frame to rotate about a rotation axis in a forward rotational direction for forward movement and a rearward rotational direction for rearward movement, and at least one drive wheel mounted on the axle. The apparatus may further comprise at least one leg movable with respect to the base, a leg actuation assembly configured to move the at least one leg in conjunction with rotation of the drive wheel, a cover mounted on the mobile base and having an exterior surface with a resemblance to a steer, and a motivating assembly configured to drive the axle in the forward rotational direction using stored energy. The motivating assembly may be configured to store energy by rotation of the axle in the rearward rotational direction.

15 Claims, 7 Drawing Sheets

(56) References Cited

U.S. PATENT DOCUMENTS

| | | | | | |
|---|---|---|---|---|---|
| 3,645,039 | A * | 2/1972 | Bross | A63H 29/18 446/459 |
| 3,711,098 | A * | 1/1973 | McCord | A01K 15/003 273/336 |
| 3,947,033 | A * | 3/1976 | Bennett | A63B 69/0068 12/85 |
| 4,266,779 | A | 5/1981 | English | |
| 4,364,570 | A | 12/1982 | Hallam | |
| 4,451,045 | A | 5/1984 | Fesmire | |
| 4,662,642 | A | 5/1987 | Archibald | |
| 4,850,931 | A * | 7/1989 | Auer | A63H 29/24 180/271 |
| 4,874,179 | A | 10/1989 | Henderson | |
| 4,981,302 | A | 1/1991 | Narramore | |
| 5,562,522 | A * | 10/1996 | Richno | A63H 29/18 446/444 |
| 5,568,926 | A * | 10/1996 | Kaptein | A63B 69/0068 273/336 |
| 5,709,386 | A | 1/1998 | Nelson | |
| 6,497,411 | B1 | 12/2002 | Nelson | |
| 6,736,399 | B1 | 5/2004 | Copenhaver | |
| 6,945,534 | B1 | 9/2005 | Lindsey | |
| 7,059,605 | B1 | 6/2006 | Hughes | |
| 7,293,775 | B1 | 11/2007 | Donnelly | |
| 7,430,990 | B1 | 10/2008 | Copenhaver | |
| 8,297,980 | B2 | 10/2012 | Reynolds | |
| 8,579,293 | B1 * | 11/2013 | Sellers | A63B 69/0068 119/839 |
| 8,783,689 | B1 | 7/2014 | Copenhaver | |
| 2003/0034613 | A1 * | 2/2003 | Tisdell | A63B 69/0068 273/359 |
| 2004/0101811 | A1 | 5/2004 | Gipson | |
| 2006/0170163 | A1 | 8/2006 | Perkins | |

* cited by examiner

MINIATURIZED STEER ROPING PRACTICE APPARATUS

BACKGROUND

Field

The present disclosure relates to roping practice apparatus and more particularly pertains to a new miniaturized steer roping practice apparatus which may move with leg motion using stored energy.

SUMMARY

In one aspect, the present disclosure relates to a miniaturized steer roping practice apparatus having a forward direction and a rearward direction. The apparatus may comprise a mobile base comprising a frame having a front and a rear, an axle rotatably mounted on the frame to rotate about a rotation axis in a forward rotational direction associated with forward movement of the frame and a rearward rotational direction associated with rearward movement of the frame, and at least one drive wheel mounted on the axle. The apparatus may further include at least one leg movable with respect to the base, a leg actuation assembly configured to move the at least one leg in conjunction with rotation of the at least one drive wheel, and a cover mounted on the mobile base and having an exterior surface with a resemblance to a steer. The apparatus may also include a motivating assembly configured to drive the axle in the forward rotational direction using stored energy, with the motivating assembly being configured to store energy by rotation of the axle in the rearward rotational direction.

In another aspect, the disclosure relates to a miniaturized steer roping practice apparatus having a forward direction and a rearward direction. The apparatus may comprise a mobile base comprising a frame having a front and a rear, an axle rotatably mounted on the frame to rotate about a rotation axis in a forward rotational direction associated with forward movement of the frame and a rearward rotational direction associated with rearward movement of the frame, and a pair of drive wheels mounted on the axle. The apparatus may further include a pair of legs pivotable with respect to the base, a leg actuation assembly configured to move the at least one leg in conjunction with rotation of the at least one drive wheel in the forward rotation direction, and a cover mounted on the mobile base and having an exterior surface with a resemblance to a steer. The apparatus may also include a motivating assembly configured to drive the axle in the forward rotational direction using stored energy, with the motivating assembly being configured to store energy by rotation of the axle in the rearward rotational direction. The motivating assembly may comprise a spool mounted on the axle, a clutch structure mounting the spool on the axle to permit selective rotation of the spool with respect to the axle, and a tension structure configured to rotate the spool to rotate the axle. The tension structure may comprise a tension member connected to the spool to apply a rotational force to the spool, with the tension member comprising a flexible member having a first end and a second end and a length between the ends and at least a portion of the length being wrappable about the spool. The first end being attached to the spool and the second end may be mounted on the frame. The tension structure may comprise a tension arm mounted on the frame to pivot between a tension position and a release position and engaging a portion of the tension member. The tension structure may further comprise a biasing member configured to apply a biasing force to the tension arm, the biasing member being attached to the tension arm and to the frame to urge the tension arm toward the release position.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
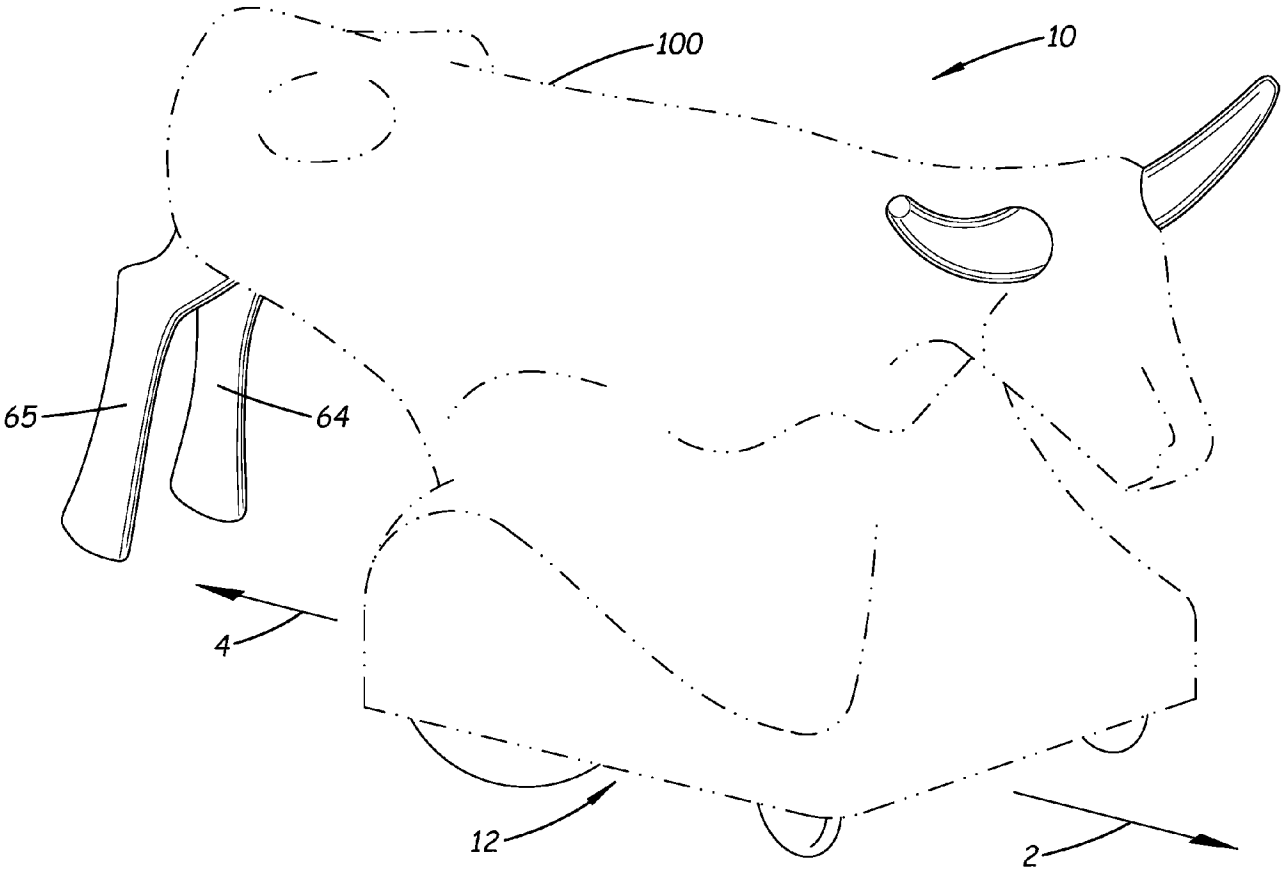
FIG. 1 is a schematic perspective view of a new miniaturized steer roping practice apparatus according to the present disclosure.
Figure 2:
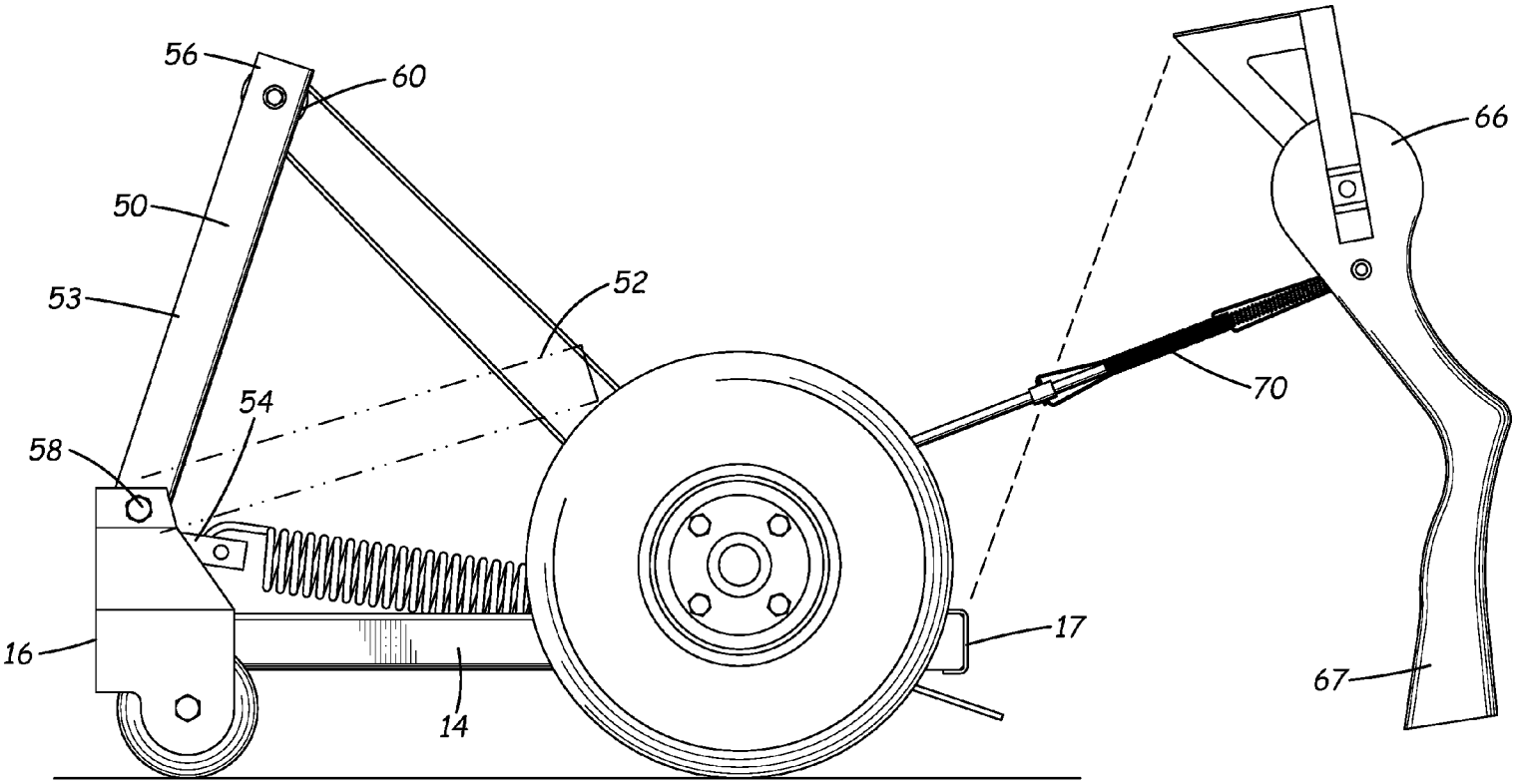
FIG. 2 is a schematic side view of the apparatus with the cover removed to reveal detail of other elements of the apparatus, according to an illustrative embodiment.
Figure 3:
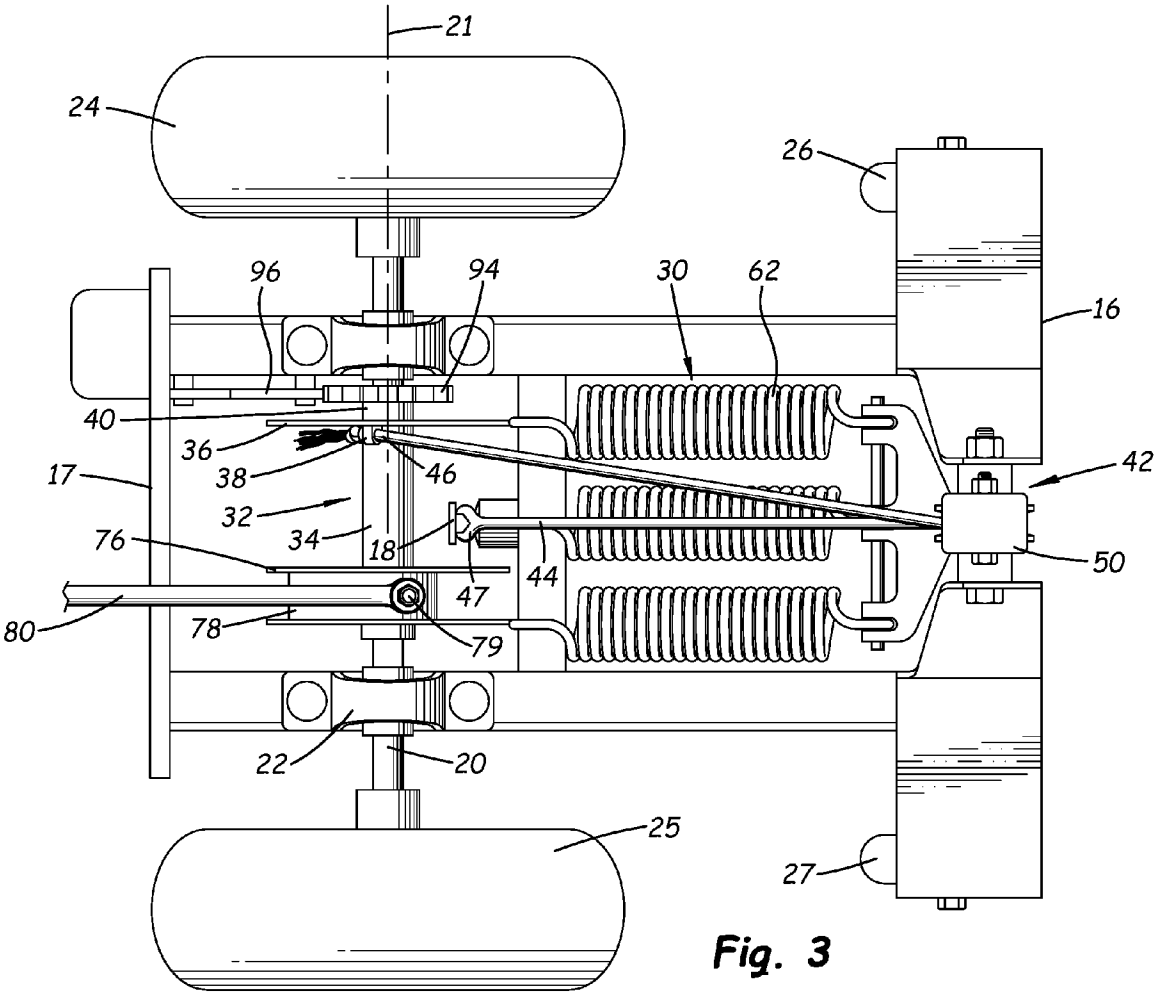
FIG. 3 is a schematic top view of a portion of the apparatus with the cover removed to reveal detail of the mobile base and the motivating assembly, according to an illustrative embodiment.
Figure 4:
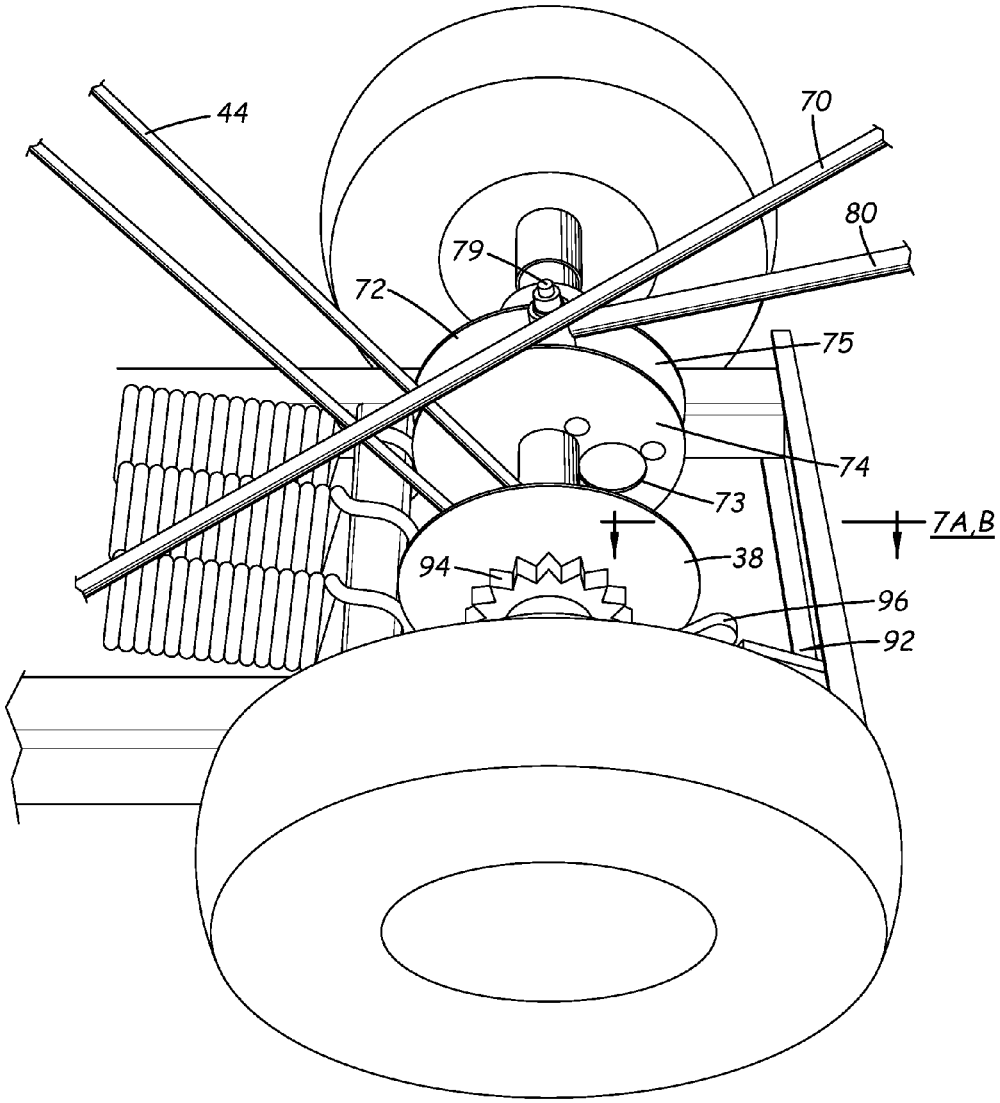
FIG. 4 is a schematic perspective view of a portion of the apparatus with the cover removed, according to an illustrative embodiment.
Figure 5:
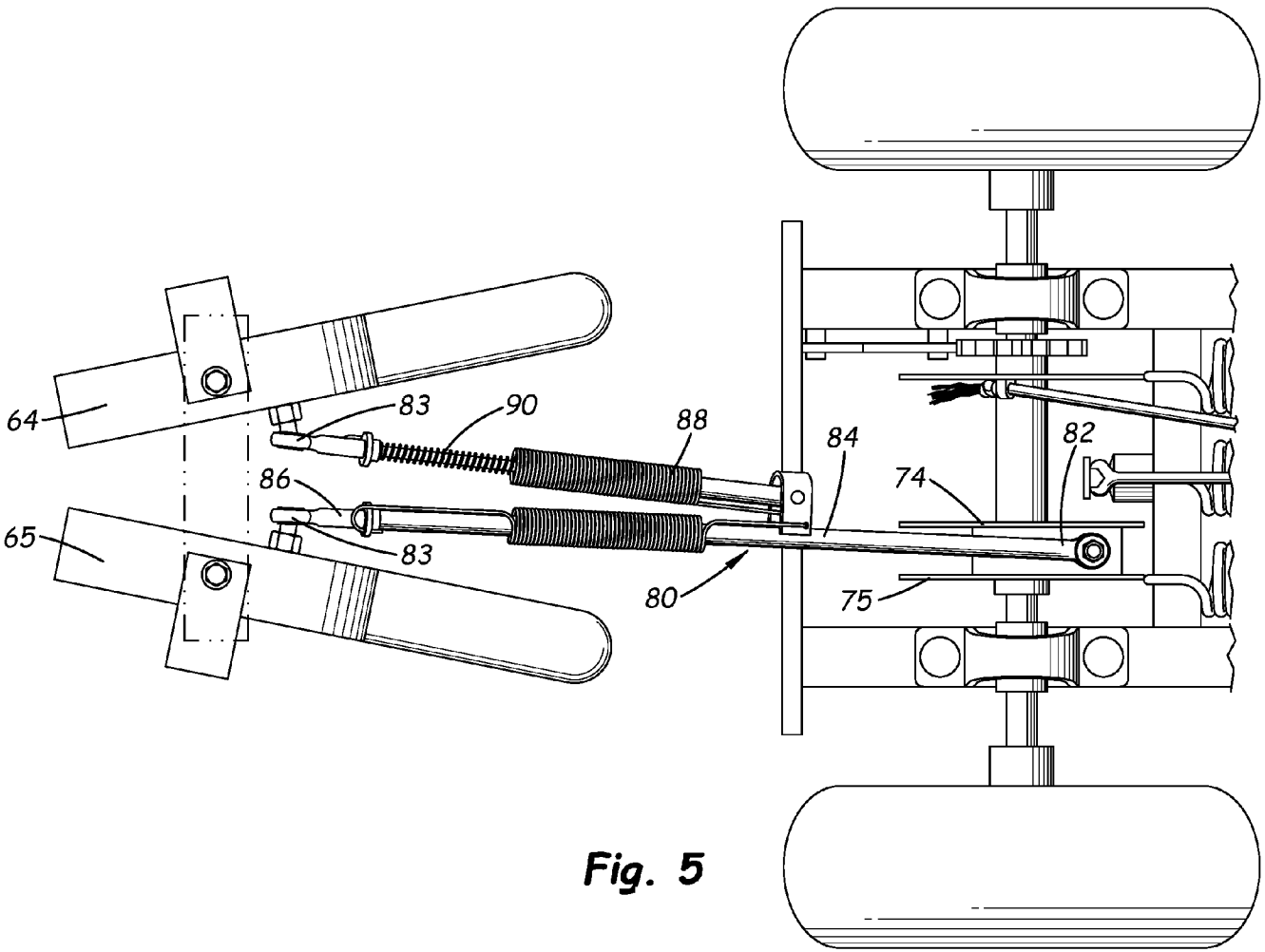
FIG. 5 is a schematic top view of the legs and leg actuation structure of the apparatus, according to an illustrative embodiment.
Figure 6B:
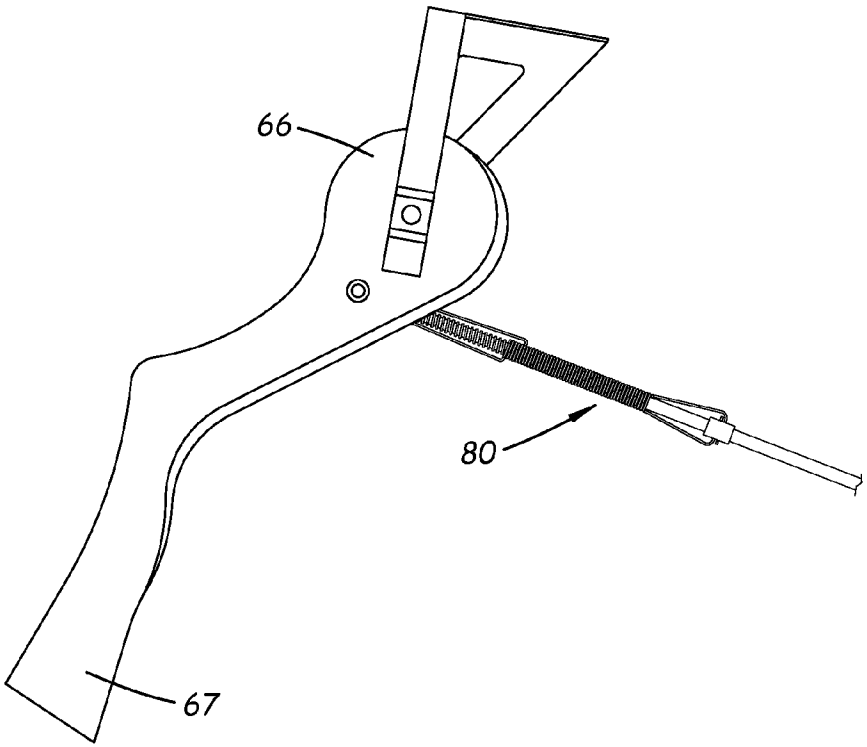
FIG. 6B is a schematic side perspective view of the legs in a rearward position, according to an illustrative embodiment.
Figure 6A:
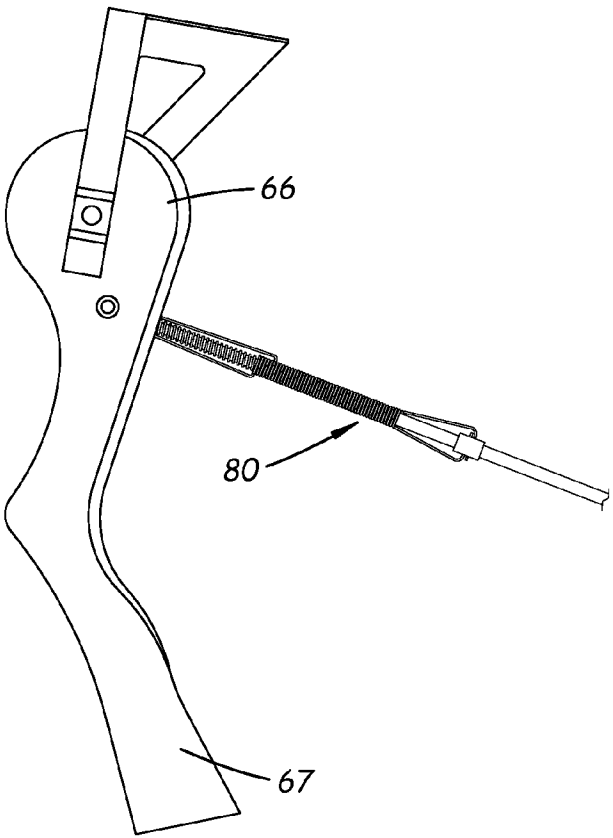
FIG. 6A is a schematic side perspective view of the legs in a forward position, according to an illustrative embodiment.
Figure 7A:
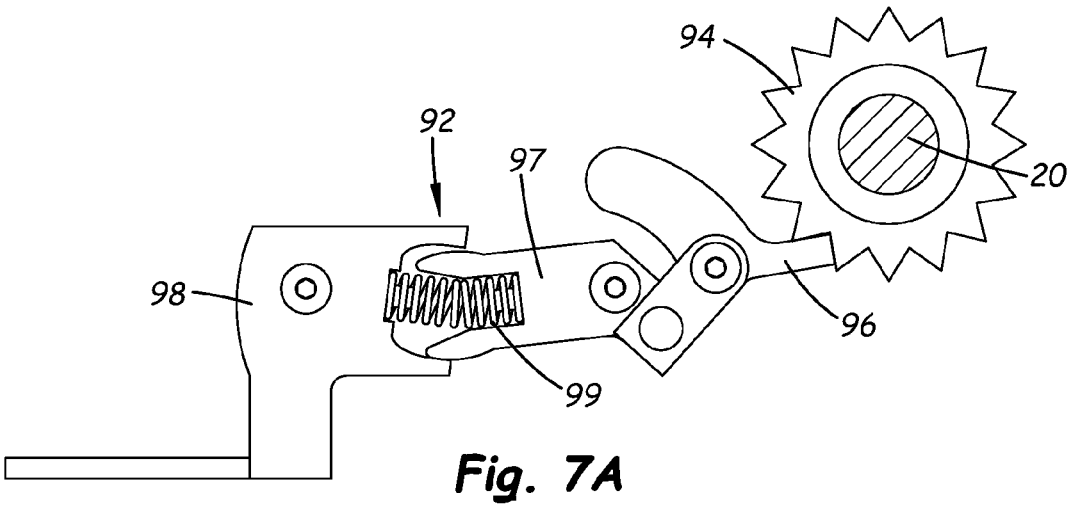
FIG. 7A is a schematic side view of the locking structure of the apparatus in a lock condition, according to an illustrative embodiment.
Figure 7B:
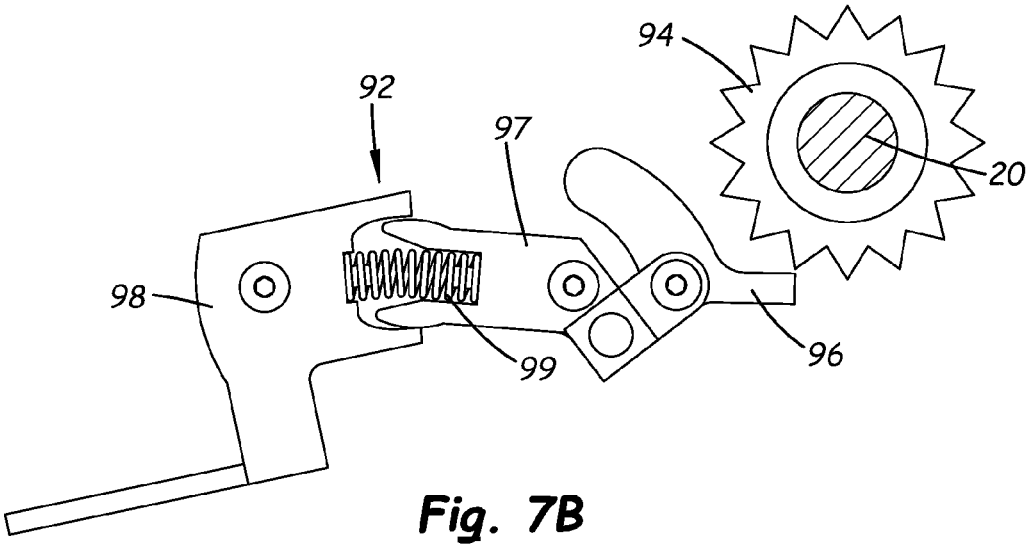
FIG. 7B is a schematic side view of the locking structure of the apparatus in a release condition, according to an illustrative embodiment.

With reference now to the drawings, and in particular to FIGS. 1 through 6 thereof, a new miniaturized steer roping practice apparatus embodying the principles and concepts of the disclosed subject matter will be described.

In some aspects, the disclosure relates to a miniaturized steer roping practice apparatus 10 which may have a forward direction 2 with a corresponding forward direction of movement, and a rearward direction 4 with a corresponding forward direction of movement. The front and rear ends of the apparatus 10 generally correspond to representations of the front and the rear of a steer, such as a head and horns located at the front and hind legs located at the rear.

The apparatus 10 may have a mobile base 12 which may include a frame 14 with a front 16 generally oriented toward the forward direction 2 and front of the apparatus 10, and a rear 17 generally oriented toward the rearward direction 4 and rear of the apparatus. A tension mount point 18 may be mounted on the frame 14. The mobile base 12 may also include an axle 20 which is rotatably mounted on the frame 14. The axle may rotate about a rotation axis 21, and may have a forward rotational direction generally associated with forward movement of the frame in the forward direction 2, and a rearward rotational direction generally associated with rearward movement of the frame in the rearward direction 4. The axle may be mounted on the frame by at least one bearing 22, and illustratively may be mounted by at least a pair of bearings.

The mobile base may further include at least one drive wheel 24 which is mounted on the axle 20 for rotation with the axle. The drive wheel may be located toward the rear 17 of the frame, which may be preferable, although the drive wheel may be located more toward the front 16 of the frame. In some embodiments, a pair of the drive wheels 24, 25 is mounted on the axle for rotation with the axle, and may be laterally spaced from each other and may be positioned on opposite sides of the frame. The mobile base 12 may also comprise at least one support wheel 26 which may be located toward the front 16 of the frame. The support wheel 26 may be able to rotate freely without resistance or assistance. In some embodiments, a pair of the support wheels 26, 27 is mounted on the frame and the wheels are laterally spaced from each other and are generally located toward the front of the frame.

The apparatus 10 may also include a motivating assembly 30 which is configured to rotate the drive wheel or wheels 24, 25. The motivating assembly 30 may engage the axle and be configured to cause the axle to rotate in at least the forward rotational direction, and also be configured such that the axle is able to actuate the motivating assembly when the axle is rotated in the rearward rotational direction. The motivating assembly 30 may be configured so that it is incapable of rotating the axle in the rearward rotational direction, and may also be configured so that the assembly 30 is not rotated by rotation of the axle in the forward rotational direction of the axle. The motivating assembly 30 may include a spool 32 mounted on the axle, and the spool may comprise a sleeve 34 which extends about the axle, and at least one flange 36 positioned adjacent to the sleeve and which may be mounted on the sleeve to rotate with the sleeve with respect to the axle. The spool may also include a mount point 38 located on the sleeve 32, or optionally on the flange 36, such that the mount point 38 is rotatable about the axle with the spool.

The motivating assembly 30 may also include a clutch structure 40 mounted between the spool 32 and the axle 20 to permit selective rotation of the spool with respect to the axle. In some embodiments, rotation of the axle in the rearward rotational direction by rolling the mobile base rearwardly is transferred to the spool while rotation of the axle in the forward rotational direction by rolling the mobile base forwardly is not transferred to the axle. Embodiments of the clutch structure 30 may also allow the axle to turn free of the motivating assembly in the forward rotational direction such that forward movement of the mobile base by momentum is not significantly resisted by the assembly 30. Embodiments of the clutch structure 30 may permit the motivating assembly to rotate the axle in the forward rotational direction but not in the rearward rotational direction. Illustratively, the clutch structure 40 may comprise a one-way clutch linking the spool to the axle, and may employ needle bearings to provide the necessary functionality.

The motivating assembly 30 may also include a tension structure 42 which is configured to rotate the spool and in turn rotate the axle 20. The tension structure 30 may be configured to apply a rotational force to the spool, and may be configured to apply a variable degree of force to the spool. In some embodiments, the tension structure includes a tension member 44 which is connected to the spool to apply a rotational force to the spool. Illustratively, the tension member 44 may comprise a flexible member, such as a cord, having a first end 46 and a second end 47 as well as a length between the ends 46, 47. At least a portion of the length of the tension member 44 may be wrappable about the spool, and the first end 46 may be attached to the spool, such as to the mount point 38 located on the sleeve 34 of the spool. The second end 47 of the tension member 44 may be mounted on the frame 14, and more specifically may be mounted on the tension mount point 18 on the frame.

The tension structure may further include a tension arm 50 which is movably mounted on the frame 14, and may have a tension position 52 and a release position 53 (see FIG. 2), The tension arm may engage the tension member 44 and may be pivotable with respect to the frame 14. The tension arm may have an inboard end 54 and an outboard end 56, and may be pivotally mounted to the frame 14 at a pivot location 58 which may be located between the inboard 54 and outboard 56 ends and may be located toward the inboard end 54. A pulley 60 may be mounted on the tension arm 50 at a location toward the outboard end 56 of the arm with a portion of the tension member 44 extending about the pulley.

The tension structure 42 may also include a biasing member 62 which is configured to apply a biasing force to the tension arm 50. The biasing member may be configured to urge the tension arm toward the release position. The biasing member 62 may be attached to the tension arm 50 and to the frame 14, and may be attached to the tension arm at a location between the pivot location 58 and the inboard end 54. The biasing member 62 may be attached to the tension arm 50 at or adjacent to the inboard end 54. Illustratively, the biasing member 62 may comprise at least one tension spring, and may comprise a plurality of tension springs. Illustratively, three tension members may be included.

The roping practice apparatus 10 may also include at least one leg 64 movable with respect to the mobile base 12. The leg 64 may be elongated with an upper end 66 and a lower end 67. The leg may be mounted for pivot movement, with the upper end 66 pivotally mounted such that movement of the leg 64 causes the lower end 67 of the leg to swing approximately in an arc. The leg 64 may pivot about a substantially horizontal axis, and the axis may be oriented generally transverse to the frame 14. In some embodiments, a pair of the legs 64, 65 may be utilized, with each of the legs being pivotable about a substantially transverse axis. The transverse axes of the legs 64, 65 may be oriented parallel to each other, but in some preferred embodiment the axes tend to converge in the forward direction 2 of the apparatus and diverge in the rearward direction 4 of the apparatus such that the lower ends 67 of the legs 64, 65 tend to converge towards each other when the lower ends of the legs move rearwardly and tend to diverge away from each other when the lower ends of the legs move forwardly.

While in some implementations the legs 64, 65 may be directly mounted on the frame 14, in some embodiments the legs are effectively mounted on the frame of the mobile base by mounting the legs to the cover 100 which is in turn mounted on the frame 14. The roping practice apparatus 10 may also include a leg actuation assembly 70 which may be configured to move the leg or legs 64, 65. The movement of the leg or legs may be coordinated with the movement of the mobile base, and may be linked to the rotation of the axle of the mobile base, such that the movements occur substantially simultaneously. Further, the relative speed of leg movement may correspond to the rotational speed of the axle, with faster rotation of the axle resulting in faster pivot movement of the legs.

In some embodiments, the leg actuation assembly 70 may comprise an eccentric actuator 72 which may be mounted on the axle and may be configured to rotate with the axle. The eccentric actuator 72 may extend radially outward from the axle and the rotation axis 21, and may have an eccentric mounting point 73 which is spaced from the rotation axis 21 of the axle. The eccentric actuator 72 may include an eccentric member 74 which is mounted on the axle to rotate with the axle and which has the eccentric mounting point 73 located thereon. The eccentric member 74 may extend radially outward from the rotation axis 21 with the mounting point 73 being located on the eccentric member radially outwardly from the rotation axis. The eccentric member 74 may comprise at least one disk, and may include a pair of disks 74, 75 which may be axially spaced from each other on the axle 20. The pair of disks 74, 75 may be oriented substantially parallel to each other.

The eccentric actuator 72 may also include a mount member 76 which is mounted on the eccentric member 74 at a location radially outward from the rotation axis 21. The mount member 76 may extend from the eccentric member, and may be positioned between the pair of disks 74, 75 and may be mounted on the pair of disks such that rotation of the disks on the axle causes the mount member 76 to rotate about the rotation axis 21. The mount member 76 may have a substantially cylindrical outer surface, and in some implementations may be formed of a material having a low friction coefficient, such as a ultra-high molecular weight substance. The eccentric actuator 72 may also include a collar 78 which is mounted on the mount member 76 in a manner permitting the collar to rotate on the mount member generally about an axis that is oriented parallel to but spaced from the rotation axis 21. The collar 78 may also have a post 79 mounted thereon.

The leg actuation assembly 70 may also include an actuating structure 80 which is connected to the axle 20 through the eccentric actuator 72. The actuating structure may have a first end 82 and a second end 83, with the first end being mounted on the eccentric actuator 72, and more specifically the post 79 located on the collar 78 of the eccentric actuator 72. The second end 83 of the actuating structure 80 may be attached to the leg 64 at an attachment location which may be spaced from the transverse axis about which the leg pivots. In embodiments employing a pair of legs 64, 65, an actuating structure 80 may be provided for each of the legs, or illustratively a portion of the actuating structure may be bifurcated such that it has a single first end 82 and a pair of second ends 83 which are each mounted on one of the legs 64, 65. The movement of the legs caused by the actuating structure may thus be coordinated with each other.

In some preferred embodiments, the distance between the first 82 and second 83 ends of the actuating structure 80 may be variable to minimize or eliminate potential damage to the actuating structure or the legs when the movement of the legs is restricted, such as by the roping of the legs by a user or inadvertent contact between the legs and environmental structures. In some embodiments, the actuating structure may include a first member 84 which is located toward the first end 82 of the actuating structure, and the first member 84 may be movably mounted to the corresponding leg. A second member 86 may be located toward the second end 83 of the actuating structure, and may be connected to the first member 84 in a manner that permits movement of the ends 82, 83 toward and away from each other. Illustratively, one of the first and second members may comprise a tubular structure, and the other of the first and second members may comprise a rod structure that is at least partially slidably inserted into the tubular structure of the one member to effectively provide a rod and cylinder arrangement.

The actuating structure 80 may also include a tension biasing element 88 which acts on the first and second members to resist movement of the first and second members away from each other, and may comprise a tension spring which has ends that are connected to the respective first and second members. The actuating structure 80 may also include a compression biasing element 90 which acts on the first and second members to resist movement of the first and second members toward each other, and the compression biasing element may comprise a compression spring having ends that are effectively connected to or abutted against the first and second members. By this structure, the actuating structure 80 has a neutral length but permits the effective length between the first and second ends to be increased under a tension bias or decreased under a compression bias such that the structure tends to return to the neutral length after the tension or compression forces are removed.

The roping apparatus 10 may also include a locking structure 92 which is configured to selectively lock rotation of the spool 32 of the motivating assembly 30 with respect to the frame 14, and in some conditions with respect to the axle 20. The locking structure 92 may have a lock condition and a release condition. The lock condition may be characterized by the motivating assembly 30 being incapable of (or locked against) applying rotational force to the axle 20 in the forward rotational direction. The lock condition may further be characterized by the rotation of the axle in the rearward rotational direction causing the motivating assembly to store tension energy. The lock condition may also be characterized by the axle being freely rotatable in the forward rotational direction with respect to the motivating assembly. The release condition may be characterized by the motivating assembly being capable of (or freed for) applying rotational force to the axle in the forward rotational direction. The release condition may further be characterized by rotation of the axle in the rearward rotational direction causing the motivating assembly to store tension energy. The release condition may also be characterized by the axle being freely rotatable in the forward rotational direction with respect to the motivating assembly.

In some embodiments, the locking structure 92 may have an engagement position generally corresponding to the lock position, and a disengagement position generally corresponding to the release condition. Illustratively, the locking structure may include a cogwheel 94 which is mounted on the axle 20 to rotate with the axle, and the cogwheel may have a plurality of teeth. The locking structure 92 may also include a pawl 96 which is movably mounted on the frame to selectively engage the cog wheel 94. The pawl may engage the cogwheel in the engagement position and may be disengaged from the cog wheel in the disengagement position. The pawl 96 may be pivotally mounted on the frame. The structure 92 may also include an intermediate member 97 which is movably mounted on the frame and movably connected to the pawl 96. The intermediate member may be pivotable with respect to the frame and may be pivotable with respect to the pawl. The locking structure may include a release lever 98 which is configured to cause engagement and disengagement of the pawl from the cogwheel. The release lever 98 may comprise a pedal movably mounted on the frame between a lock position generally corresponding to the lock condition and release position generally corresponding to the release condition. The pedal may be pivotably mounted on the frame and may extend from the frame in a location that is relatively easily accessible to the foot of the user. The locking structure 92 may also include a compression spring 99 which may engage the intermediate member and the release lever. The compression spring may be compressed between the intermediate member and the release lever to hold the intermediate member and release lever in the engagement position or the disengagement position, with pressure (such as foot pressure) applied to the pedal being able to overcome the bias of the compression spring and move the elements between the positions.

The steer roping apparatus 10 may also include a cover 100 which is mounted on the mobile base and may have an exterior surface with a resemblance to a steer. The cover 100 may include a pair of horns positioned on a head portion of the cover, and in some embodiments the horn may be removable from the remainder of the cover in order to interchange horns of different sizes on the cover. Optionally, the legs may be mounted on the cover 100 to provide support for the legs, and the cover may effectively form a connection between the frame of the mobile base and the pivot mounting of the legs.

The motivating assembly 30 may effectively store energy that may be used to motivate or move the apparatus in a forward direction. In some embodiments, energy may be stored in the motivating assembly by moving the steer roping apparatus 10 in a rearward direction across a floor surface which causes the wheels and axle of the mobile base to rotate in a rearward rotational direction. The rearward rotational movement of the axle causes the spool to rotate and thus wrap the flexible line or cord of the tension member 44 about the spool 32, which in turn causes the tension arm 50 to be drawn toward the tension position 52 and away from the release position 53. The movement of the tension arm causes stretching of the tension spring or springs of the biasing member 62 which stores potential energy in the springs. The tension in the springs urges the tension arm toward the release position and away from the tension position, which in turn pulls or unwinds the tension member 44 from the spool 32 and urges the axle to rotate in a forward rotational direction thus motivating the mobile base and the entire apparatus 10 in a forward direction. Operation of the locking structure 92 is not necessary to cause the motivating assembly 30 to operate, but may provide a convenient selective lock on the release of any tension energy stored by the motivating assembly until forward movement of the apparatus 10 is desired.

In operation, the apparatus 10 may be pushed or pulled in a rearward direction which rotates the axle in a rearward rotational direction and causes tension energy to be stored by the motivating assembly. If the locking structure 92 is in the lock condition, forward movement of the apparatus (by forward rotation of the axis and wheels) will be blocked by engagement of the pawl with the cogwheel, while rotation of the axle in the rearward rotational direction will not be impeded. Upon movement of the locking structure to the release condition and thus movement of the locking structure to the disengagement position, the pawl is disengaged from the cogwheel and rotation of the axle in the forward rotational direction is no longer impeded and any tension energy stored by the motivating assembly is applied to the axle and the apparatus may be moved forwardly. Rotation of the axle in the forward rotational direction also causes movement of the leg or legs of the apparatus at a speed that generally corresponds to the speed of forward movement of the apparatus across the floor surface. Completion of the release of the stored tension energy does not necessarily cause the apparatus 10 to stop movement, as the axle is able to freewheel with respect to the motivating assembly until the forward momentum has been exhausted.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that the steps disclosed in the text and/or the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A miniaturized steer roping practice apparatus having a forward direction and a rearward direction, the apparatus comprising:

a mobile base comprising a frame having a front and a rear, an axle rotatably mounted on the frame to rotate about a rotation axis in a forward rotational direction associated with forward movement of the frame and a rearward rotational direction associated with rearward movement of the frame, and at least one drive wheel mounted on the axle;

at least one leg movable with respect to the base;

a leg actuation assembly configured to move the at least one leg in conjunction with rotation of the at least one drive wheel;

a cover mounted on the mobile base and having an exterior surface with a resemblance to a steer; and a motivating assembly configured to drive the axle in the forward rotational direction using stored energy, the motivating assembly being configured to store energy by rotation of the axle in the rearward rotational direction.

2. The apparatus of claim 1 wherein the motivating assembly is configured to store energy as tension.

3. The apparatus of claim 1 wherein the motivating assembly comprises:

a spool mounted on the axle;

a clutch structure mounting the spool on the axle to permit selective rotation of the spool with respect to the axle; and a tension structure configured to rotate the spool to rotate the axle.

4. The apparatus of claim 3 wherein the tension structure comprises a tension member connected to the spool to apply a rotational force to the spool, the tension member comprising a flexible member having a first end and a second end and a length between the ends, at least a portion of the length being wrappable about the spool, the first end being attached to the spool, the second end being mounted on the frame.

5. The apparatus of claim 4 wherein the tension structure further comprises a tension arm mounted on the frame to pivot between a tension position and a release position and engaging the flexible member, the tension arm having a pulley located toward an outboard end with a portion of the tension member extending about the pulley.

6. The apparatus of claim 5 wherein the tension structure further comprises a biasing member configured to apply a biasing force to the tension arm, the biasing member being attached to the tension arm and to the frame to urge the tension arm toward the release position.

7. The apparatus of claim 6 wherein the biasing member comprising at least one tension spring.

8. The apparatus of claim 1 wherein the at least one leg comprises a pair of legs with each of the legs being pivotable about a substantially transverse axis.

9. The apparatus of claim 8 wherein the transverse axes of the legs converge in the forward direction and diverge in the rearward direction such that lower ends of the legs tend to converge when the lower ends of the legs move rearwardly and diverge when the lower ends of the legs move forwardly.

10. The apparatus of claim 1 wherein the leg actuation assembly includes an actuating structure connected to the axle and the at least one leg to transfer motion of the axle to the leg.

11. The apparatus of claim 10 wherein the actuating structure further comprises a first member located toward a first end of the actuating structure and being movably mounted on the at least one leg, a second member located toward a second end of the actuating structure, a tension biasing element acting on the first and second members to resist movement of the first and second members away from each other, and a compression biasing element acting on the first and second members to resist movement of the first and second members toward each other.

12. The apparatus of claim 1 further comprising at least one support wheel rotatable about a transverse axis and being freely rotatable with respect to the frame.

13. The apparatus of claim 3 further comprising a locking structure configured to selectively lock rotation of the spool with respect to the frame, the locking structure having a lock condition and a release condition.

14. The apparatus of claim 13 wherein the lock condition is characterized by the motivating assembly being incapable of rotating the axle in the forward rotational direction, and wherein the release condition is characterized by the motivating assembly being capable of rotating the axle in the forward rotational direction.

15. A miniaturized steer roping practice apparatus having a forward direction and a rearward direction, the apparatus comprising:

a mobile base comprising a frame having a front and a rear, an axle rotatably mounted on the frame to rotate about a rotation axis in a forward rotational direction associated with forward movement of the frame and a rearward rotational direction associated with rearward movement of the frame, and a pair of drive wheels mounted on the axle;

a pair of legs pivotable with respect to the base;

a leg actuation assembly configured to move the at least one leg in conjunction with rotation of the at least one drive wheel in the forward rotation direction;

a cover mounted on the mobile base and having an exterior surface with a resemblance to a steer; and a motivating assembly configured to drive the axle in the forward rotational direction using stored energy, the motivating assembly being configured to store energy by rotation of the axle in the rearward rotational direction, the motivating assembly comprising:

a spool mounted on the axle;

a clutch structure mounting the spool on the axle to permit selective rotation of the spool with respect to the axle; and a tension structure configured to rotate the spool to rotate the axle, the tension structure comprising:

a tension member connected to the spool to apply a rotational force to the spool, the tension member comprising a flexible member having a first end and a second end and a length between the ends, at least a portion of the length being wrappable about the spool, the first end being attached to the spool, the second end being mounted on the frame;

a tension arm mounted on the frame to pivot between a tension position and a release position and engaging a portion of the tension member; and a biasing member configured to apply a biasing force to the tension arm, the biasing member being attached to the tension arm and to the frame to urge the tension arm toward the release position.

* * * * *